United States Patent [19]

Curtin et al.

[11] Patent Number: 4,594,118

[45] Date of Patent: Jun. 10, 1986

[54] EXPLOSIVE COMPOSITION WITH BUBBLE ENHANCER

[75] Inventors: David J. Curtin, Ashburton; David E. Yates, East Brunswick, both of Australia

[73] Assignee: ICI Australia Limited, Melbourne, Australia

[21] Appl. No.: 723,568

[22] Filed: Apr. 15, 1985

[30] Foreign Application Priority Data

Apr. 19, 1984 [AU] Australia ..... PG4650

[51] Int. Cl.[4] ..... C06B 45/00

[52] U.S. Cl. ..... 149/2; 149/21; 149/46; 149/60; 149/61; 149/76; 149/83; 149/109.6; 149/110

[58] Field of Search ..... 149/2, 21, 60, 46, 61, 149/76, 83, 109.6, 110

[56] References Cited

U.S. PATENT DOCUMENTS

| | | | |
|---|---|---|---|
| 4,216,040 | 8/1980 | Sudweeks et al. | 149/21 |
| 4,472,215 | 9/1984 | Binet et al. | 149/2 |
| 4,473,418 | 9/1984 | Bampfield et al. | 149/2 |
| 4,490,194 | 12/1984 | Cooper et al. | 149/2 |

*Primary Examiner*—Stephen J. Lechert, Jr.

*Attorney, Agent, or Firm*—Cushman, Darby & Cushman

[57] ABSTRACT

A gas bubble sensitized water-in-oil emulsion explosive composition comprising a discontinuous aqueous phase comprising at least one oxygen-releasing salt, a continuous water-immiscible organic phase, a discontinuous gaseous phase, a water-in-oil emulsifying agent and at least one agent capable of facilitating the production of gas bubbles in the presence of said water-immiscible organic phase.

19 Claims, No Drawings

EXPLOSIVE COMPOSITION WITH BUBBLE ENHANCER

This invention relates to water-in-oil emulsion explosive compositions having a discontinuous aqueous phase and a continuous oil or water-immiscible liquid organic phase and in particular to water-in-oil emulsion explosive compositions containing at least one agent whose function is to facilitate the uniform production of very small gas bubbles in the composition, and to processes for the preparation thereof.

Emulsion explosive compositions have been widely accepted in the explosives industry because of their excellent explosive properties and ease of handling. The emulsion explosive compositions now in common use in the industry were first disclosed by Bluhm in U.S. Pat. No. 3,447,978 and comprise as components: (a) a discontinuous aqueous phase comprising discrete droplets of an aqueous solution of inorganic oxygen-releasing salts; (b) a continuous water-immiscible organic phase throughout which the droplets are dispersed; (c) an emulsifier which forms an emulsion of the droplets of oxidizer salt solution throughout the continuous organic phase; and (d) a discontinuous gaseous phase.

It is generally recognised that one of the reasons for the excellent explosive properties of such emulsion explosive compositions is the intimate contact present between the oxygen-releasing salt(s), in the form of discrete droplets of an aqueous solution thereof, and the fuel, in the form of the continuous water-immiscible organic phase.

It has now been found that the use of certain agents in the preparation of water-in-oil emulsion explosive compositions leads to emulsions which have enhanced explosive characteristics in comparison with conventional water-in-oil emulsion explosive compositions. The range of suitable agents for use in our invention is comparatively wide and sometimes comprises an organic moiety containing a hetero component. Thus for example one class of agent falling within the range of our invention is the class of compounds commonly referred to as silicones; yet another class is the class commonly referred to as halocarbons which may be typified by reference to fluorocarbons.

Accordingly the invention provides a gas bubble sensitized water-in-oil emulsion explosive composition comprising a discontinuous aqueous phase comprising at least one oxygen-releasing salt, a continuous water-immiscible organic phase, a water-in-oil emulsifying agent, a discontinuous gaseous phase, and at least one agent capable of facilitating the production of gas bubbles in the presence of said water immiscible organic phase.

Although the stabilisation of foams in aqueous systems by surfactants is well known and the type of suitable surfactant is predictable, the use of agents for foam stabilisation in non-aqueous systems, such as are the compositions of this invention, is not well-known and suitable agents cannot be predicted. However we have found that there is a correlation between the results obtained from a foam stabilisation test, described hereinafter and the ability of various agents to facilitate the production of small gas bubbles in emulsion explosive compositions.

Accordingly in another aspect of the invention there is provided an explosive composition as hereinbefore described wherein the agent referred to therein is characterized further in that it has properties which provide a suitable stabilizing effect and which are established by means of a foam stabilization test as hereinafter described.

In the said foam stabilization test 0.2 part by weight of active ingredient of the candidate agent or mixture of agents to be tested is added to and mixed with 100 parts by weight of diesel fuel. 5 ml of the mixture is placed in a graduated cylindrical vessel of 15 mm internal diameter. The mixture is shaken for 15 seconds. A foam forms on the surface of the mixture. The volume ($V_5$) of the foam is measured 5 minutes after the mixture has ceased to be shaken using the graduations on the vessel. The foam volume ($V_{60}$) is measured again 60 minutes after the mixture has ceased to be shaken, the vessel and the mixture being kept at a temperature of 18° to 22° C. during this period of time. A foam stability parameter $\phi^{60/5}$ is calculated from the foam volumes by means of the formula $$\phi^{60/5}=V60/V5$$

By way of illustration of the application of the foam stabilisation test, Table 1 records the results for a number of agents and mixtures of agents.

TABLE 1

| Foam Stabilisation Tests | | | |
|---|---|---|---|
| | | Foam Properties | |
| Agent A | Agent B (if B is present the ratio w/w of A:B is 5:1) | $V^5$ (Volume expressed in $cm^3$) | $\phi^{60/5}$ |
| Fluorocarbons | | | |
| "Fluorad" FC 430 | | 5.2 | 1.0 |
| "Fluorad" FC 740 | | 4.6 | 0.76 |
| Simple acids & amines | | | |
| Stearic acid* | | 0 | 0 |
| Lauric acid* | | 0 | 0 |
| Octadecylamine* | | 0 | 0 |
| Sorbitan esters | | | |
| Sorbitan trioleate ("Span" 85)* | | 0 | 0 |
| Sorbitan monostearate ("Span" 60)* | | 0.5 | 1.0 |
| Sorbitan monopalmitate ("Span" 40)* | | 0.7 | 0.71 |
| Sorbitan alkoxylates | | | |
| Poly(oxyethylene) (20) Sorbitan monopalmitate ("Tween" 40)* | | 0 | 0 |
| Fatty alkoxylates | | | |
| Tallow amine ethylene oxide derivatives ("Teric" 17M2)* | | 0 | 0 |
| Poly(oxypropylene) (15) stearyl ether ("Arlamol" E)* | | 0 | 0 |
| Poly(oxyethylene) (2) oleyl ether ("Brij" 93)* | | 0 | 0 |
| Miscellaneous | | | |
| Heptadecenyl oxazoline ("Alkaterge" T)* | | 0.5 | 0 |
| Phosphate ester of a non-ionic surface active agent ("Teric" 305)* | | 0 | 0 |
| "Fluorad" FC740 | "Fluorad" FC430 | 9.5 | 0.75 |
| "Fluorad" FC740 | "Fluorad" FC431 | 4.7 | 0.85 |
| "Fluorad" FC740 | "Span" 40 | 4.3 | 0.91 |

* = Not suitable for use in the invention.

The designations "Fluorad", "Alkaterge", "Arlamol", "Brij", "Span", "Teric" and "Tween" are trade names.

It has been found that only those agents or mixtures of agents in which the $V_5$ value was equal to or greater than 1 cubic centimeter and had a $\phi^{60/5}$ equal to or greater than 0.3 imparted the desired gas bubble stabilization effect which characterizes the compositions of this invention. Hence the foam stabilizing agents preferred for use in the compositions of the invention are those having a $V_5$ value equal to or greater than 1 cubic centimetre and a $\phi^{60/5}$ value equal to or greater than 0.3 as determined by the foam stabilization test hereinbefore described.

As referred to above the agent which is capable of facilitating the production of gas bubbles in the compositions of the invention sometimes comprises an organic moiety containing a hetero component such as for example, an atom of nitrogen, silicon, sulphur or a halogen in the gasophilic portion of the agent.

Accordingly in a further aspect of the invention there is provided an explosive composition as hereinbefore described wherein the said agent comprises an organic moiety containing at least one hetero component in the gasophilic portion of the agent.

By gasophilic we mean that part of the agent which is capable of facilitating the production of gas bubbles in the composition of the invention. Thus certain gasophilic portions of the agent may be able to promote the formation of gas bubbles in the water immiscible organic phase, whilst other gasophilic portions may be more suitable to form and maintain bubbles within a certain size range in the water immiscible organic phase.

The agents used in the compositions of the invention may vary widely. Amongst the agents we have found that certain, non-ionic compounds selected from the halo alkyl esters are suitable, especially when the halo atom is fluorine. So as to facilitate the understanding of the nature of these halo alkyl esters they may, for the purposes of the invention, be considered to comprise three portions; a lipophilic portion which is joined to a joining portion which in turn is joined to a gasophilic portion.

The lipophilic portion is suitably a hydrocarbon the nature of which may vary widely. Thus the hydrocarbon may be in the form of a short or long carbon chain which may be straight or branched; other hydrocarbons may be in the form of rings for example aromatic or heterocyclic rings; yet again for example the hydrocarbon may comprise a polyether component derived from at least one alkylene oxide, for example, ethylene oxide, propylene oxide or butylene oxide. The joining portion may vary widely and we have found that in suitable agents the joining group may comprise, for example, one or more of an amide, an amine, an ester, an ether or a sulphonamide.

The gasophilic portion may comprise, for example, straight or branched chains, aromatic compounds or derivatives of alkylene glycols. Thus for example commercial non-ionic fluoralkyl esters available from 3M Australia Pty Ltd of Melbourne Australia under the designations "Fluorad" FC 430 and "Fluorad" FC 740 are believed to comprise an alkyl radical such as a perfluorinated carbon chain. As examples of other halo-bearing radicals in suitable agents mention is made of gasophilic portions comprising radicals of the type $\text{-}(CFH_2)_x\text{—}(CF_2)_y$ or of the type $\text{-}(CFH)_z$ wherein, x, y & z are integers in the range from as wide as 1 to 1000 or in a narrower range such as for Example 1 to 20. Some agents may take the form of polymers and in this regard suitable gasophilic portions may be found in the so-called "comb" polymers which comprise pendant groups attached to a polymeric backbone.

Agents comprising a suitable gasophilic portion for use in the compositions of our invention are typified by, but not limited to, the agents set out in Table 1. The proportion of the agents present in our compositions may be determined by simple experiment and will depend to some extent on the nature of the aqueous phase, the water-immiscible organic phase, the emulsifier and on the extent to which it is desired to produce gas bubbles in the compositions. Certain of the agents are highly efficacious in providing bubbles in our compositions and are useful when they are present in the compositions in a concentration as low as 0.0001% w/w. For other agents the concentration may need to be much higher, for example, up to 5% w/w, but, in general it is not usually necessary to add more than 2% w/w of an agent to obtain a satisfactory product. It will be appreciated that for reasons of economy it is desirable to keep the concentration of the agent in a composition as low as possible commensurate with the effect which it is desired to obtain and thus in many instances it is preferred that the agent constitutes from 0.0005 to 1.5% w/w of the composition and often lies within a range of from 0.001 to 1% w/w of the composition. Whilst generally single agents are used it lies within the invention to use two or more agents at least one of which should conform to the requirements of the foam stabilization test hereinbefore described, to form a mixed agent suitable for use in the invention. It has also been observed that such mixed agents sometimes exhibit synergism in that the capability of the mixed agent to facilitate the production of gas bubbles in a composition of the invention is greater than the sum of the capabilities of the individual agents.

The emulsion explosive compositions of the present invention comprise a discontinuous gaseous component. The gaseous component is incorporated into the compositions of the present invention as fine gas bubbles dispersed throughout the composition optionally in the presence of hollow particles which are often referred to as microballoons, or of porous particles, or mixtures thereof. The discontinuous phase of fine gas bubbles may be incorporated into the compositions of the present invention by mechanical agitation, injection or bubbling the gas through the composition or by in situ generation of the gas by chemical means. Suitable chemicals for the in situ generation of gas bubbles include peroxides such as, for example, hydrogen peroxide, nitrites such as, for example, sodium nitrite, nitrosoamines such as, for example, N,N'dinitrosopentamethylenetetramine, alkali metal borohydrides such as, for example, sodium borohydride, and carbonates such as sodium carbonate. Preferred chemicals for the in situ generation of gas bubbles are nitrous acid and its salts which decompose under conditions of acid pH to produce gas bubbles. Thiourea and/or thiocyanate ions may be used to accelerate the decomposition of a nitrite gassing agent. Examples of suitable hollow particles include small hollow microspheres of glass and resinous materials such as phenol-formaldehyde, poly(vinylidene chloride)/poly(acrylonitrile) copolymers and ureaformaldehyde. Examples of suitable porous materials include expanded minerals such as perlite.

Typically, sufficient discontinuous gaseous phase and optional hollow particles and/or porous particles are used in the compositions of the present invention to give a composition having a density in the range of from 0.7 to 1.4 g/cm$^3$.

Using conventional mixing techniques to provide a discontinuous gaseous phase in emulsion explosive compositions in the absence of the agents referred to above we have found that the bubbles are relatively large and often comparatively unstable. Thus, for example, the bubbles often have diameters up to 2000 microns and average bubble diameters of less than 250 microns are rare. We have found that the incorporation of the agents referred to above in our compositions provides bubbles of smaller diameter than has been hitherto possible. Thus by choice of an appropriate agent at a desired concentration the mean gas bubble diameter in the discontinuous gas phase may be controlled. Thus, for example, in a comparative explosive composition wherein no agent was present and the average gas bubble diameter was 280 microns, the addition and incorporation of 0.01% w/w of a suitable agent to the explosive composition to provide a composition of the invention reduced the average gas bubble diameter to 160 microns, and when the concentration was increased to 1% w/w the average gas bubble diameter was reduced to 45 microns.

Suitable oxygen-releasing salts for use in the aqueous phase component of the composition of the present invention include the alkali and alkaline earth metal nitrates, chlorates and perchlorates, ammonium nitrate, ammonium chlorate, ammonium perchlorate and mixtures thereof. The preferred oxygen-releasing salts include ammonium nitrate, sodium nitrate and calcium nitrate. More preferably the oxygen-releasing salt comprises ammonium nitrate or a mixture of ammonium nitrate and sodium or calcium nitrates.

Typically, the oxygen-releasing salt component of the compositions of the present invention comprises from 45 to 95% and preferably from 60 to 90% by weight of the total composition. In compositions wherein the oxygen-releasing salt comprises a mixture of ammonium nitrate and sodium nitrate the preferred composition range for such a blend is from 5 to 80 parts of sodium nitrate for every 100 parts of ammonium nitrate. Therefore, in the preferred compositions of the present invention the oxygen-releasing salt component comprises from 45 to 90% by weight (of the total composition) ammonium nitrate or mixtures of from 0 to 40% by weight (of the total composition) sodium or calcium nitrates and from 50 to 90% by weight (of the total composition) ammonium nitrate.

In the preparation of the compositions of the present invention preferably all of the oxygen-releasing salt is in aqueous solution. Typically, the amount of water employed in the compositions of the present invention is in the range of from 1 to 30% by weight of the total composition. Preferably the amount employed is from 5 to 25%, and more preferably from 6 to 20%, by weight of the total composition.

The water-immiscible organic phase component of the composition of the present invention comprises the continuous "oil" phase of the water-in-oil emulsion explosive and is the fuel. Suitable organic fuels include aliphatic, alicyclic and aromatic compounds and mixtures thereof which are in the liquid state at the formulation temperature. Suitable organic fuels may be chosen from fuel oil, diesel oil, distillate, kerosene, naphtha, waxes, (e.g. microcrystalline wax, paraffin wax and slack wax) paraffin oils, benzene, toluene, xylenes, asphaltic materials, polymeric oils such as the low molecular weight polymers of olefins, animal oils, fish oils, and other mineral, hydrocarbon or fatty oils, and mixtures thereof. Preferred organic fuels are liquid hydrocarbons generally referred to as petroleum distillates such as gasoline, kerosene, fuel oils and paraffin oils.

Typically, the organic fuel or continuous phase of the emulsion explosive composition of the present invention comprises from 2 to 15% by weight and preferably 3 to 10% by weight of the total composition.

The emulsifying agent component of the composition of the present invention may be chosen from the wide range of emulsifying agents known in the art for the preparation of water-in-oil emulsion explosive compositions. Examples of such emulsifying agents include alcohol alkoxylates, phenol alkoxylates, poly(oxyalkylene) glycols, poly(oxyalkylene) fatty acid esters, amine alkoxylates, fatty acid esters of sorbitol and glycerol, fatty acid salts, sorbitan esters, poly(oxyalkylene) sorbitan esters, fatty amine alkoxylates, poly(oxyalkylene) glycol esters, fatty acid amides, fatty acid amide alkoxylates, fatty amines, quaternary amines, alkyloxazolines, alkenyloxazolines, imidazolines, alkyl-sulfonates, alkylarylsulfonates, alkylsulfosuccinates, alkylphosphates, alkenylphosphates, phosphate esters, lecithin, copolymers of poly(oxyalkylene) glycols and poly(12-hydroxystearic acid), and mixtures thereof. Among the preferred emulsifying agents are the 2-alkyl- and 2-alkenyl-4,4'-bis (hydroxymethyl) oxazoline, the fatty acid esters of sorbitol, lecithin, copolymers of poly(oxyalkylene) glycols and poly(12-hydroxystearic acid), and mixtures thereof, and particularly sorbitan mono-oleate, sorbitan sesquioleate, 2-oleyl- 4,4'-bis (hydroxymethyl) oxazoline, mixture of sorbitan sesquioleate, lecithin and a copolymer of poly(oxyalkylene glycol and poly (12-hydroxystearic acid), and mixtures thereof.

Typically, the emulsifying agent component of the composition of the present invention comprises up to 5% by weight of the total composition. Higher proportions of the emulsifying agent may be used and may serve as a supplemental fuel for the composition but in general it is not necessary to add more than 5% by weight of emulsifying agent to achieve the desired effect. One of the advantages of the compositions of the present invention is that stable emulsions can be formed using relatively low levels of emulsifying agent and for reasons of economy it is preferable to keep to amount of emulsifying agent used to the minimum required to have the desired effect. The preferred level of emulsifying agent used is in the range from 0.1 to 2.0% by weight of the total composition.

If desired other, optional fuel materials, hereinafter referred to as secondary fuels, may be incorporated into the compositions of the present invention in addition to the water-immiscible organic fuel phase. Examples of such secondary fuels include finely divided solids, and water-miscible organic liquids which can be used to partially replace water as a solvent for the oxygen-releasing salts or to extend the aqueous solvent for the oxygen-releasing salts. Examples of solid secondary fuels include finely divided materials such as: sulfur; aluminium; and carbonaceous materials such as gilsonite, comminuted coke or charcoal, carbon black, resin acids such as abietic acid, sugars such as glucose or dextrose and other vegetable products such as starch, nut meal, grain meal and wood pulp. Examples of water-miscible organic liquids include alcohols such as methanol, glycols such as ethylene glycol, amides such as formamide and amines such as methylamine.

Typically, the optional secondary fuel component of the compositions of the present invention comprise from 0 to 30% by weight of the total composition.

It lies within the invention that there may also be incorporated into the emulsion explosive compositions hereinbefore described other substances or mixtures of substances which are oxygen-releasing salts or which are themselves suitable as explosive materials. As a typical example of such a modified emulsion explosive composition reference is made to compositions wherein there is added to and mixed with an emulsion explosive composition as hereinbefore described up to 90% w/w of an oxidizing salt such as ammonium nitrate or an explosive composition comprising a mixture of an oxidizing salt such as ammonium nitrate and fuel oil and commonly referred to by those skilled in the art as "Anfo ". The compositions of "Anfo" are well known and have been described at length in the literature relating to explosives. It also lies within the invention to have as a further explosive component of the composition well known explosive materials comprising one or more of for example trinitrotoluene, nitroglycerine or pentaerythritol tetranitrate.

Accordingly there is provided an explosive composition comprising as a first component an emulsion explosive composition as hereinbefore described and as a second component an amount of material which is an oxidizing salt or which is in its own right an explosive material.

If desired the aqueous solution of the compositions of the present invention may comprise optional thickening agents which optionally may be crosslinked. The thickening agents, when used in the compositions of the present invention, are suitably polymeric materials, especially gum materials typified by the galactomannan gums such as locust bean gum or guar gum or derivatives thereof such as hydroxypropyl guar gum. Other useful, but less preferred, gums are the so-called biopolymeric gums such as the heteropolysaccharides prepared by the microbial transformation of carbohydrate material, for example the treatment of glucose with a plant pathogen of the genus Xanthomonas typified by *Xanthomonas campestris.* Other useful thickening agents include synthetic polymeric materials and in particular synthetic polymeric materials which are derived, at least in part, from the monomer acrylamide.

Typically, the optional thickening agent component of the compositions of the present invention comprises from 0 to 2% by weight of the total composition.

As indicated above, when used in the compositions of the present invention, the thickening agent optionally may be crosslinked. It is convenient for this purpose to use conventional crosslinking agents such as zinc chromate or a dichromate either as a separate entity or as a component of a conventional redox system such as, for example, a mixture of potassium dichromate and potassium antimony tartrate.

Typically, the optional crosslinking agent component of the compositions of the present invention comprises from 0 to 0.5% and preferably from 0 to 0.1% by weight of the total composition.

The pH of the emulsion explosive compositions of the present invention is not narrowly critical. However, in general the pH is between 0 and 8 and preferably the pH is between 1 and 6, and may be controlled by suitable addition of conventional additives, for example inorganic or organic acids and salts.

The emulsion explosive compositions of the present invention may be prepared by a number of methods. In one preferred method of manufacture the compositions may be prepared by: dissolving said oxygen-releasing salts in water at a temperature above the fudge point of the salt solution, preferably at a temperature in the range from 25 to 110° C., to give an aqueous salt solution; combining said aqueous salt solution, said water-immiscible organic phase, said water-in-oil emulsifying agent, and optionally said agent capable of facilitating the production of gas bubbles in the presence of said water-immiscible organic phase with rapid mixing to form a water-in-oil emulsion; mixing until the emulsion is uniform; mixing into said emulsion an agent capable of in situ generation of gas bubbles by chemical means and, if not already present, said agent capable of facilitating the production of gas bubbles in the presence of said water-immiscible organic phase; and optionally mixing into said emulsion any solid ingredients.

Possible variations of this general procedure will be evident to those skilled in the art of the preparation of emulsion explosive compositions.

Thus in yet another embodiment the invention provides a method for the preparation of the novel emulsion explosive compositons herein described.

The invention is now illustrated by, but is not limited to, the following examples in which all parts and percentages are expressed on a weight basis. Examples 1 and 11 to 13 are included for the purpose of comparison and do not fall within the scope of the invention.

EXAMPLE 1

An aqueous composition was prepared by mixing 7550 parts of ammonium nitrate, 1905 parts of water, 10 parts of thiourea, and 35 parts of sodium acetate trihydrate.

The composition was heated to a temperature of 70° C., and then, whilst being stirred, nitric acid was added thereto until the pH of the acidified composition was 4.3. The acidified composition was added slowly to a rapidly stirred blend of 380 parts of paraffin oil and 100 parts of sorbitan mono-oleate which was at a temperature of 20° C. When the addition was complete stirring was continued for a further 60 seconds. To the mixture so obtained there was added with agitation 20 parts of an aqueous sodium nitrite solution wherein the ratio of sodium nitrite to water was 1:2. Agitation of the product so obtained was continued for 10 seconds. Samples were taken of the emulsified product so obtained, and these were placed on microscope slides, photographed and the average bubble size in the emulsified product was measured. In this comparative example the average bubble size was 280 microns.

EXAMPLE 2

The procedure of Example 1 was repeated except that in the present example the blend of Example 1 was replaced by a blend of 380 parts of paraffin oil, 100 parts of sorbitan mono-oleate and 1 part of an agent available commercially from 3M Australia Pty Ltd of Melbourne Australia and designated FC430. The agent is believed to be a non-ionic fluoro alkyl ester and is in the form of a viscous liquid. The average bubble size so obtained was 160 microns.

EXAMPLE 3

The procedure of Example 2 was repeated except that in the present example the blend of Example 2 was replaced by a blend of 370 parts of paraffin oil, 100 parts of sorbitan mono-oleate and 10 parts of agent FC430. The average bubble size so obtained was 75 microns.

EXAMPLE 4

The procedure of Example 2 was repeated except that in the present example the blend of Example 2 was replaced by a blend of 360 parts of paraffin oil, 100 parts of sorbitan mono-oleate and 20 parts of agent FC430. The average bubble size so obtained was 55 microns.

EXAMPLE 5

The procedure of Example 2 was repeated except that in the present example the blend of Example 2 was replaced by a blend of 280 parts of paraffin oil, 100 parts of sorbitan mono-oleate and 100 parts of agent FC430. The average bubble size so obtained was 45 microns.

EXAMPLE 6

The procedure of Example 2 was repeated except that in the present example the blend of Example 2 was modified by replacing the agent FC430 by 1 part of an agent available commercially from 3M Australia Pty Ltd and designated FC740. The agent is believed to be a non-ionic fluoroalkyl ester.

It is supplied as a 50% solution in an alkyl aromatic material. The average bubble size so obtained was 66 microns.

EXAMPLE 7

The procedure of Example 3 was repeated except that in the present example the blend of Example 3 was modified by replacing the agent FC430 by 10 parts of agent FC740. The average bubble size so obtained was 30 microns.

EXAMPLES 8 TO 10

The following general procedure demonstrates the continuous preparation of compositions of the present invention.

An aqueous oxidizer salt solution, comprising the oxidizer salt(s) in water at a temperature of 70° C., and the continuous phase, comprising oil or fuel and the emulsifying agent, were continuously fed into a pin-mill operating at 450 rpm. The emulsion formed in the pin-mill was continuously fed into a blender together with the gassing agent and the agent capable of facilitating the production of gas bubbles and the mixture was thoroughly blended. Samples of the emulsified product so obtained were taken for analysis of average bubble diameter density and explosive performance measurement.

The compositions detailed in Table 2 below were prepared following the above procedure.

TABLE 2

| Component (part by weight) | Example No 8 | 9 | 10 |
|---|---|---|---|
| Ammonium Nitrate | 7150 | 7150 | 7600 |
| Sodium Nitrate | 400 | 400 | — |
| Water | 1750 | 1750 | 1900 |
| Paraffin Oil | 600 | 120 | 420 |
| Paraffin Wax | — | 240 | — |
| Microcrystalline Wax | — | 240 | — |
| Sorbitan Mono-oleate | 100 | 100 | 80 |

TABLE 2-continued

| Component (part by weight) | Example No 8 | 9 | 10 |
|---|---|---|---|
| Sodium Nitrite[a] | 13 | 13 | 13 |
| "Fluorad" FC 740 | 1.4 | 1.4 | 1.4 |

[a]Added as a 33.3% aqueous solution.

EXAMPLES 11 TO 13

The procedures of Examples 8 to 10 were repeated except that the agent capable of facilitating the production of gas bubbles was omitted from the composition to give comparative Examples 11 to 13 respectively.

EXAMPLE 14

This example demonstrates the reduced average bubble size and improved explosive properties of the compositions of the invention.

Samples of the emulsion explosive compositions prepared as described in Examples 8 to 10 were placed on microscope slides, photographed and the average size of the gas bubbles in the emulsified product was measured. The average size of the gas bubbles in the emulsion compositions prepared for comparison purposes as described in Examples 11 to 13 was determined in the same manner.

The explosive properties of the emulsion compositions of the invention prepared as described in Examples 8 to 10 and comparative Examples 11 to 13 were determined using the Plate Dent Test (ref. "Numerical Modelling of Detonations ", C L Mader, The University of California Press, Berkeley, 1979).

In field trials, the emulsion explosive composition of Example 8 was loaded into 2 m deep 130 mm diameter boreholes in ferruginous rock. It was found that the composition detonated after being left in the borehole for at least five weeks. By comparison the emulsion explosive composition of comparative Example 11 failed to detonate after being left in the borehole for only five days.

The results of the gas bubble size determination, plate dent test measurement and the density of the emulsion compositions of the invention of Examples 8 to 10 and of the comparative emulsion compositions not of the invention of Examples 11 to 13 are detailed in Table 3 below.

TABLE 3

| Example No. | Average Bubble Diameter (μm) | Dent Depth (mm) | Density (g/cm$^3$) |
|---|---|---|---|
| 8 | 47 | 8 | 1.22 |
| Comparison 11 | 160 | 4 | 1.22 |
| 9 | 93 | 9 | 1.19 |
| Comparison 12 | 144 | 4 | 1.19 |
| 10 | 48 | —a | 1.21 |
| Comparison 13 | 202 | —a | 1.21 |

a. The velocity of detonation of the Example 10 composition was 6.3 km/sec after preparation and 6.1 km/sec after storage for 55 days. By way of comparison the velocity of detonation of the comparative Example 13 composition was 5.6 km/sec after preparation and 4.9 km/sec after storage for 55 days.

EXAMPLE 15

This Example illustrates an emulsion explosive composition of the invention comprising, as a first component, an emulsion explosive composition and, as a second component, an oxidizing salt or explosive material.

An emulsion explosive composition comprising ammonium nitrate (7150 parts), sodium nitrate (400 parts), water (1750 parts), paraffin oil (600 parts) and sorbitan mono-oleate (100 parts) was prepared following the procedure described for Example 8. To this emulsion composition (6940 parts) there was added ammonium nitrate prills (3000 parts), a 33.3% aqueous solution of sodium nitrite (30 parts) and a 5% solution of "Fluorad" FC740 in diesel oil (30 parts) and the mixture was blended until uniform.

The composition showed no appreciable density increase when pumped through a 50 m long 50 mm diameter delivery hose whereas, in contrast, a comparative composition prepared without the addition of the agent capable of facilitating the production of gas bubbles ("Fluorad " FC740) suffered a 5% increase in density when pumped in the same manner.

We claim:

1. A gas bubble sensitized water-in-oil emulsion explosive composition comprising a discontinuous aqueous phase comprising at least one oxygen-releasing salt, a continuous water-immiscible organic phase, a discontinuous gaseous phase, a water-in-oil emulsifying agent and at least one agent capable of facilitating the production of gas bubbles in the presence of said water-immiscible organic phase.

2. A composition according to claim 1 wherein said agent capable of facilitating the production of gas bubbles in the composition which when subjected to a foam stabilization test wherein:

(i) 5.0 ml of a mixture of 0.2 parts by weight of active ingredient of said agent capable of facilitating the production of gas bubbles and 100 parts by weight of diesel fuel at a temperature of 18 to 22° C. is added to a 15 mm diameter tube; and (ii) the mixture is shaken for 15 seconds;

produces a foam which after standing for a period of five minutes has a volume ($V_5$) of not less than 1.0 $cm^3$ and after standing for a period of sixty minutes has a ratio ($\phi 60/5$) of foam volume after sixty minutes ($V_{60}$) to foam volume after 5 minutes of not less than 0.3.

3. A composition according to claim 2 wherein in said foam stabilization test said agent capable of facilitating the production of gas bubbles in the composition produces a $V_5$ value of greater than 4.0 $cm^3$ and $\phi 60/5$ ratio of greater than 0.5.

4. A composition according to claim 3 wherein said agent capable of facilitating the production of gas bubbles in the composition is a non-ionic fluoroalkyl ester.

5. A composition according to claim 1 wherein said agent capable of facilitating the production of gas bubbles in the composition comprises from 0.0001 to 5.0% by weight of said composition.

6. An emulsion explosive composition according to claim 1 wherein said oxygen-releasing salt is selected from the group consisting of the alkali metal, alkaline earth metal and the ammonium, nitrates, chlorates and perchlorates, and mixtures thereof.

7. An emulsion explosive composition according to claim 6 wherein said oxygen-releasing salt is selected from the group consisting of ammonium nitrate, sodium nitrate, calcium nitrate and mixtures thereof.

8. An emulsion explosive composition according to claim 1 wherein the oxygen-releasing salt component comprises from 45 to 95% by weight of the total composition.

9. An emulsion explosive composition according to claim 1 wherein said water-immiscible organic fuel is selected from the group consisting of fuel oil, diesel oil, distillate, furnace oil, kerosene, naphtha, sump oil, waxes, paraffin oil, benzene, toluene, xylenes, asphaltic materials, polymeric oils, animal oils, fish oils and mixtures thereof.

10. An emulsion explosive composition according to claim 9 wherein said water-immiscible organic fuel is selected from the group consisting of fuel oil, diesel oil, distillate, furnace oil, sump oil, waxes and paraffin oil.

11. An emulsion explosive composition according to claim 1 wherein said continuous water-immiscible organic phase comprises from 2 to 15% by weight of the total composition.

12. An emulsion explosive composition according to claim 1 wherein said emulsifying agent is selected from the group consisting of alcohol alkoxylates, phenol alkoxylates, poly(oxyalkylene) sorbitan esters, fatty amine alkoxylates, poly(oxyalkylene) glycol esters, fatty acid amides, fatty acid amide alkoxylates, fatty amines, quaternary amines, alkyloxazolines, alkenyloxazolines, imidazolines, alkylsulfonates, alkylarylsulfonates, alkylsulfosuccinates, alkylphosphates, alkenylphosphates, phosphate esters, lecithin, copolymers of poly(oxyalkylene) glycols and poly(12-hydroxystearic acid), and mixtures thereof.

13. An emulsion explosive composition according to claim 12 wherein said emulsifying agent is selected from the group consisting of 2-alkyl4,4'-bis (hydroxymethyl) oxazolines, the fatty acid esters of sorbitol, lecithin, copolymers of poly(oxyalkylene) glycols and poly (12-hydroxystearic acid), and mixtures thereof.

14. An emulsion explosive composition according to claim 13 wherein said emulsifying agent is selected from the group consisting of sorbitan mono-oleate, sorbitan sesquioleate, 2-oleyl-4,4'-bis(hydroxymethyl) oxazoline, a mixture of sorbitan sesquioleate, lecithin and a copolymer of poly(oxyalkylene) glycol and poly (12-hydroxystearic acid), and mixtures thereof.

15. An emulsion explosive composition according to claim 1 wherein said emulsifying agent comprises from 0.1 to 2.0% by weight of the total composition.

16. An emulsion explosive composition according to claim 1 wherein said aqueous phase comprises from 1 to 30%, by weight of the total composition of water.

17. An explosive composition according to claim 1 wherein sufficient discontinuous gaseous phase is used to give a composition having a density in the range of from 0.7 to 1.4 $g/cm^3$.

18. An explosive composition comprising as a first component an emulsion explosive composition as defined according to claim 1 and as a second component an amount of material which is an oxidizing salt or which in its own right is an explosive material.

19. A process for the preparation of a gas bubble sensitized emulsion explosive composition comprising a discontinuous aqueous phase comprising at least one oxygen-releasing salt, a continuous water-immiscibile organic phase, a discontinous gaseous phase, a water-in-oil emulsifying agent, and at least one agent capable of facilitating the production of gas bubbles in the presence of said water-immiscible organic phase, which process comprises:

(a) dissolving said oxygen-releasing salts in water at a temperature above the fudge point of the salt solution, preferably at a temperature in the range from 25 to 110° C., to give an aqueous salt solution;

(b) combining said aqueous salt solution, said water-immiscible organic phase, said water-in-oil emulsifying agent, and optionally said agent capable of facilitating the production of gas bubbles in the presence of said water-immiscible organic phase with rapid mixing to form a water-in-oil emulsion;

(c) mixing until the emulsion is uniform;

(d) mixing into said emulsion an agent capable of in situ generation of gas bubbles by chemical means and, if not already present, said agent capable of facilitating the production of gas bubbles in the presence of said water-immiscible organic phase; and (e) optionally mixing into said emulsion any solid ingredients.

* * * * *